US006414646B2

(12) United States Patent
Luh

(10) Patent No.: US 6,414,646 B2
(45) Date of Patent: Jul. 2, 2002

(54) VARIABLE BEAMWIDTH AND ZOOM CONTOUR BEAM ANTENNA SYSTEMS

(75) Inventor: Howard Ho-shou Luh, Sunnyvale, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/753,148

(22) Filed: Jan. 2, 2001

Related U.S. Application Data

(63) Continuation-in-part of application No. 09/531,613, filed on Mar. 21, 2000, now Pat. No. 6,198,455.

(51) Int. Cl.[7] ..... H01Q 13/00

(52) U.S. Cl. ..... 343/781 CA; 343/757; 343/765

(58) Field of Search ..... 343/757, 765, 343/781 CA, 781 R, 781 P, 836, 837, 758, 840; H01Q 1/42, 13/00

(56) References Cited

U.S. PATENT DOCUMENTS 4,355,314 A * 10/1982 Ohm ..... 343/779
4,464,666 A * 8/1984 Watanabe et al. ..... 343/781 P
4,603,334 A * 7/1986 Mizuguchi et al. ..... 343/779
6,043,788 A * 3/2000 Seavey ..... 343/781 CA
6,198,455 B1 * 3/2001 Luh ..... 343/781 CA
6,266,024 B1 * 7/2001 Ramanujam et al. . 343/781 CA

* cited by examiner

*Primary Examiner*—Tho Phan
(74) *Attorney, Agent, or Firm*—Anthony W. Karambelas

(57) ABSTRACT

Variable beamwidth antenna systems for use on spacecraft that is capable of changing their beamwidths while the spacecraft in on orbit. The variable beamwidth antenna systems include a main reflector, a subreflector, a feed horn, a main reflector displacement mechanism and a feed horn (or subreflector) displacement mechanism. For broaden the beamwidth, the RF feed horn and the subreflector are moved close together by proper distance. The main reflector is moved away from the subreflector along a line through centers of their respective surface by a distance given by a predetermined equation. Another embodiment of the present invention provides for a zoom contour beam antenna system that radiates a contour beam and whose beam is variable or zoomable.

13 Claims, 14 Drawing Sheets

VARIABLE BEAMWIDTH AND ZOOM CONTOUR BEAM ANTENNA SYSTEMS

CROSS REFERENCE TO RELATED APPLICATIONS

This application is a continuation-in-part application of U.S. patent application Ser. No. 09/531,613, filed Mar. 21, 2000 is now U.S. Pat. No. 6,198,455.

BACKGROUND

The present invention relates generally to antennas for use on spacecraft, and more particularly, to variable beamwidth and zoom contour beam antenna systems designed for use on spacecraft.

The present invention relates to improvements in offset Gregorian reflector antenna systems for use on communication satellites. Due to unpredictability of communication traffic, it is desirable that the beamwidth of the antenna radiation pattern be changeable when the spacecraft is on orbit.

When a satellite is in an elliptical orbit, the view of the coverage area (CONUS, for example) from the satellite changes as the satellite travels. The size of the coverage area viewed from the satellite is inversely proportional to the distance between the satellite and the earth. Under such circumstances, in order that a communication system on the satellite is to be operated efficiently, it is required that (1) the antenna radiates a contour beam (the beam contour matches the boundary of the coverage) and (2) the contour beam is variable or zoomable (size of the beam changes) in space.

Previously known zoom antennas are limited to radiate (1) a circular beams (not a contour beam) wherein the radiation contour of antenna matches the boundary of the coverage area, such as is disclosed in U.S. patent application Ser. No. 09/531,613, filed Mar. 21, 2000, assigned to the assignee of the present invention, and (2) a defocused elliptical beam, not a zoomed contour beams such as is disclosed in U.S. Pat. No. 5,977,923, entitled "Reconfigurable, zoomable, turnable, elliptical-beam antenna", by Contu, et al, issued Nov. 2, 1999.

Accordingly, it would be advantageous to have improved variable beamwidth and zoom contour beam antenna systems that may be used on a spacecraft that has a changeable beamwidth. It would also be advantageous to have improved zoom contour beam antenna systems that radiate a contour beam, and wherein the contour beam is variable or zoomable.

SUMMARY OF THE INVENTION

The variable beamwidth antenna system comprises a main reflector, a reflector displacement mechanism, a subreflector, a feed horn, and a feed horn displacement mechanism. The reflector displacement mechanism can place the main reflector at any desired location, while the feed displacement mechanism can place the feed horn at any desired location. More specifically, the main reflector displacement mechanism controls the spacing between the main reflector and the subreflector; while the feed displacement mechanism controls the spacing between the feed and the subreflector.

To implement the present invention, two mechanical movements are required. First, the RF feed horn and the subreflector are moved closer together. Second, the main reflector is moved away from the subreflector. Alternatively, the subreflector is moved closer to the RF feed horn, and the main reflector is moved away from the subreflector.

Two mechanical movements are not independent. They are related by $$y = \frac{d^2 x}{c^2 - x(c+d)}$$

where "x" is the distance of RF feed horn displacement, and "y" is the distance of the main reflector displacement.

When x=y=0, the antenna arrangement is in the focused condition. Under the focused condition, the focal point of the paraboloidal main reflector is coincident with one of the foci of the elliptical subreflector, and the feed horn is located at the other focus of the subreflector. The terms "c" and "d" in the above equation are the distance between the RF feed horn and the subreflector, and the distance between the focal point of the main reflector and subreflector, respectively, when the antenna is in focus.

A reduced-to-practice embodiment of the present variable beamwidth antenna has 3 dB beamwidth that can be changed while the spacecraft is on orbit by proper displacements of any two components among the main reflector, the subreflector and the feed.

Another embodiment of the present invention comprises a zoom contour beam antenna system that radiates a contour beam and whose beam is variable or zoomable. The present invention produces a zoom contour beam, wherein the radiation contour of antenna matches the boundary of the coverage area. This is possible because the present invention utilizes two mechanical displacement mechanisms respectively coupled to a main shaped reflector and a shaped subreflector that are moveable to provide zoomable contoured beams. The zoom contour beam provides higher gain in the coverage area, and thus improves the efficiency of the satellite communication system in which it is employed.

More particularly, an exemplary zoom contour beam antenna system comprises a shaped subreflector, a shaped main reflector. a feed horn, a main reflector displacement mechanism coupled to the shaped main reflector, and a subreflector displacement mechanism coupled to the shaped subreflector. The main reflector displacement mechanism repositions the main reflector, and the subreflector displacement mechanism repositions the subreflector. Thus, the subreflector displacement mechanism adjusts the position of the subreflector relative to the feed horn, and the main reflector displacement mechanism adjusts the position of the main reflector relative to the subreflector in order to zoom the beam produced by the antenna system. the repositioning of the various components is done in accordance with a predetermined displacement equation.

Thus, in accordance with the teachings of the present invention, a Gregorian reflector antenna may be used in circumstances where the desired antenna radiation pattern(s) is (are) required to be broadened (changed). Both the main reflector and the subreflector are attached to mechanical devices (displacement mechanisms) such that the reflectors can be displaced. The displacements of the two reflectors are not independent, and are related according to the displacement equation. The present invention is not limited to systems having a single pencil beam antenna, and may be used in circumstances involving multiple beam (multiple feed horn) antennas. The present invention may also be employed with a contoured beam antenna. In such a contoured beam antenna application, both the main reflector and subreflector are shaped to obtain a desired (for example, CONUS) radiation pattern.

BRIEF DESCRIPTION OF THE DRAWINGS

The various features and advantages of the present invention may be more readily understood with reference to the following detailed description taken in conjunction with the accompanying drawings wherein like reference numerals designate like structural elements, and in which.

DETAILED DESCRIPTION

Figure 1:
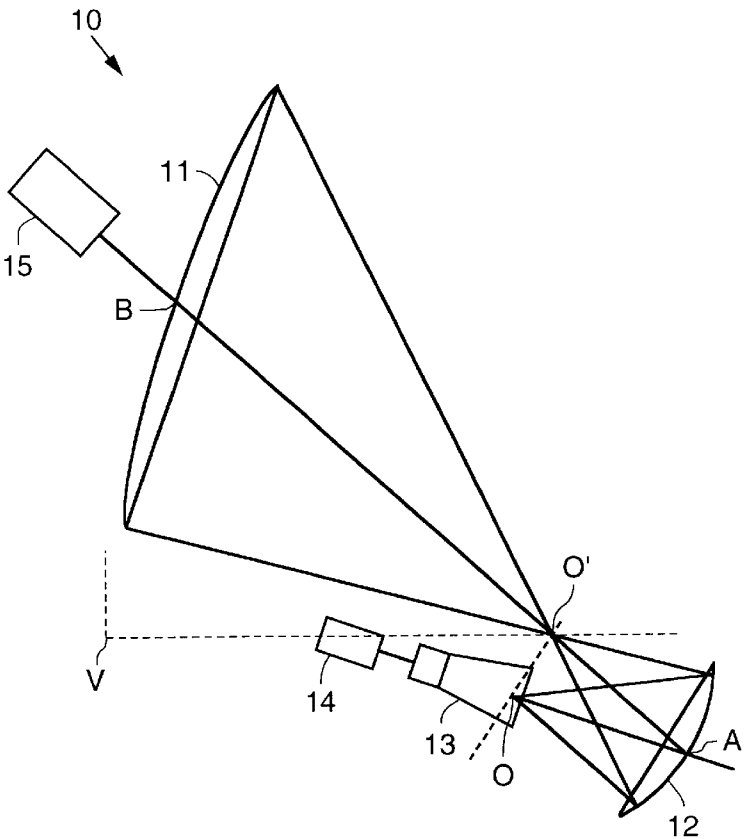
FIG. 1 illustrates a first embodiment of a variable beamwidth antenna system in accordance with the principles of the present invention.

Referring to the drawing figures, FIG. 1 illustrates a first embodiment of a variable beamwidth antenna system 10 in accordance with the principles of the present invention. The variable beamwidth antenna system 10 comprises a main reflector 11, a subreflector 12, a feed horn 13, a feed horn displacement mechanism 14, and a main reflector displacement mechanism 15. The function of the feed horn displacement mechanism 14 is to reposition the feed horn 13, and the function of the main reflector displacement mechanism 15 is to reposition the main reflector 11.

The subreflector 12 is a sector of an ellipsoidal surface, whose two foci are at O' and O. The main reflector is a sector of paraboloidal surface. When the antenna is in the focused position, i.e., the case where neither the main reflector 11 nor the feed horn 13 is displaced, the focal point of the main reflector 11 is located at O', and the feed horn 13 is located at O, as shown in FIG. 1. Point A in FIG. 1 is the intersection point of the axis of the feed horn 13 and the surface of the subreflector 12. Point B is the intersection of the surface of the main reflector 11 and line AO'. The distance OA is "c" in Equation (1) below, and the distance AO' is "d" in Equation (1).

$$y = \frac{d^2 x}{c^2 - x(c+d)} \tag{1}$$

where "x" is the distance of RF feed horn displacement, and "y" is the distance of the main reflector displacement. Under the focused position, the antenna system 10 provides the narrowest radiation pattern.

Figure 2:
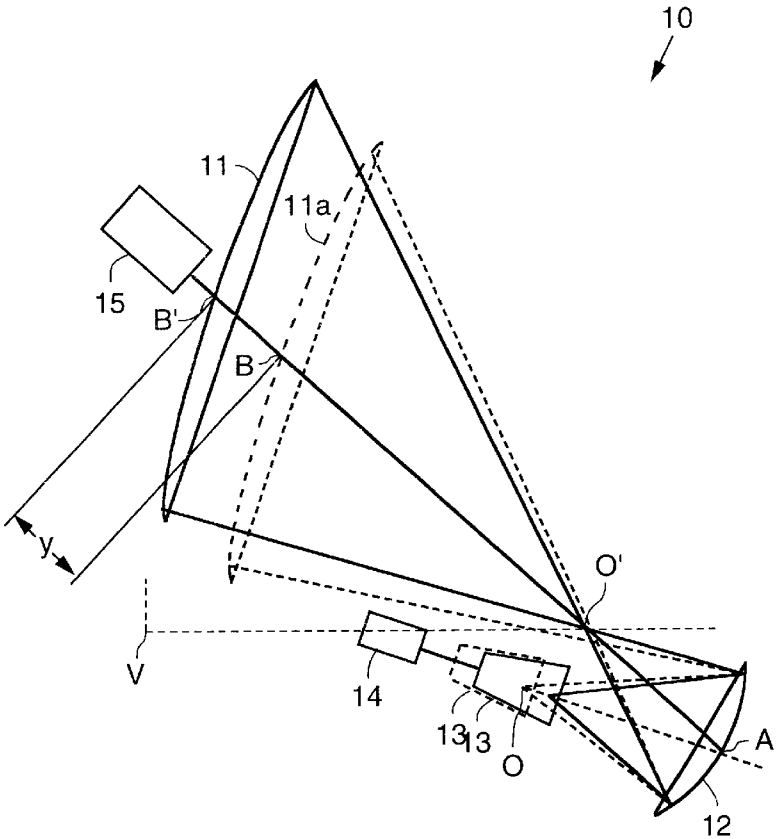
FIG. 2 illustrates a reduced-to-practice embodiment of the variable beamwidth antenna system shown in FIG. 1.

FIG. 2 illustrates the action of a reduced-to-practice embodiment of the variable beamwidth antenna system 10. In order to broaden the beamwidth, two mechanical motions are required. First, the feed displacement mechanism 14 must push (or reposition) the feed horn 13 closer to the subreflector 12.13*a* in FIG. 2 is the new feed horn position. Second, the reflector displacement mechanism 15 must pull (or reposition) the main reflector 11 farther away from the subreflector 12. The new position of the main reflector is identified as main reflector 11*a* in FIG. 2. The feed horn displacement "x" and the main reflector displacement "y" are not two independent variables. They are related by Equation (1).

Figure 3:
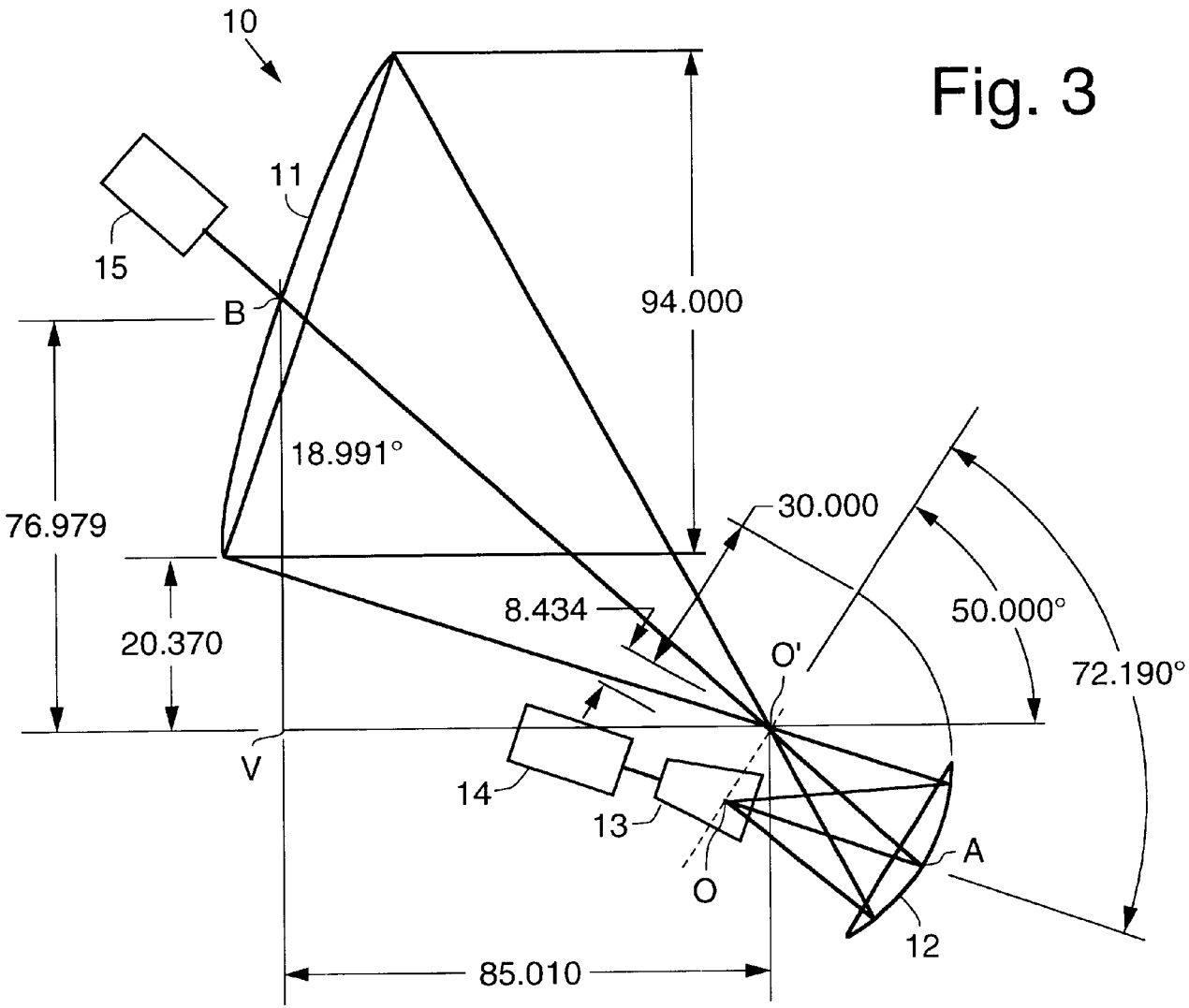
FIG. 3 illustrates design parameters of exemplary variable beamwidth antenna system when the antenna is in focused condition.

A numerical example will now be illustrated. An exemplary variable beamwidth antenna system 10 with exemplary design parameters is shown in FIG. 3. For this antenna geometry, c=38.138 inches and d=36.826 inches.

Figure 4:
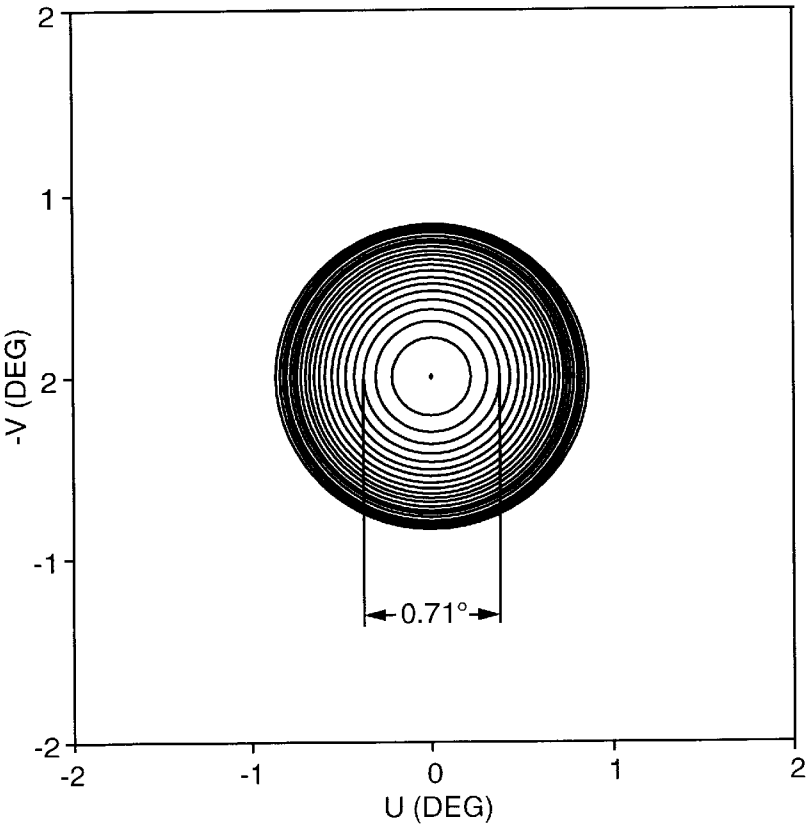
FIG. 4 illustrates the antenna radiation pattern of the antenna shown in FIG. 3.

FIG. 4 shows radiation contours of the exemplary system 10 when the system is in focus, i.e., when x=y=0. The 3 dB beamwidth of the beam shown in FIG. 4 is approximately 0.7 degrees.

Figure 5:
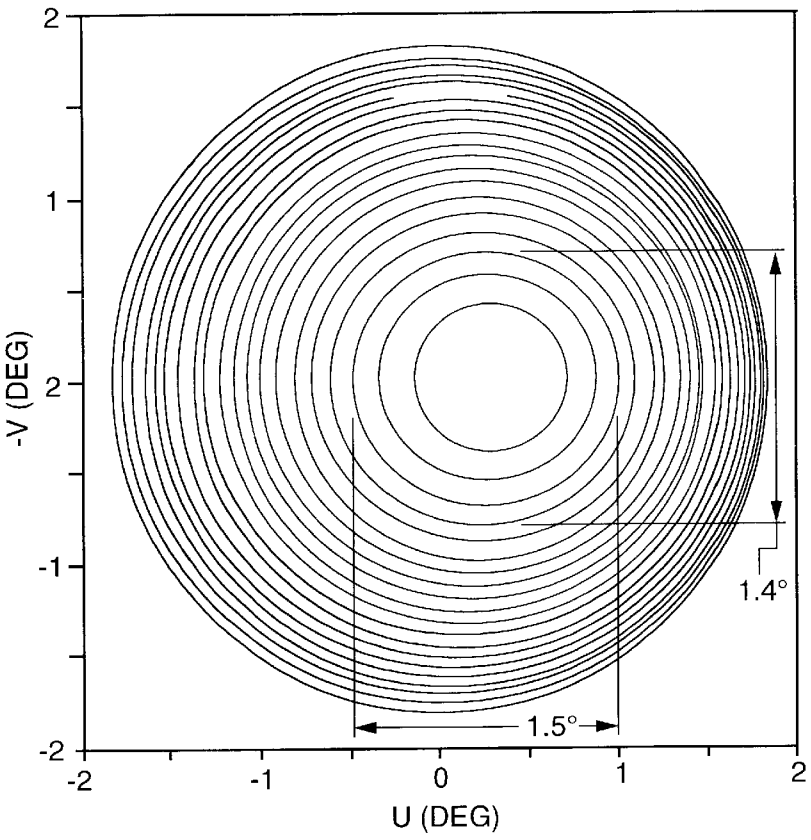
FIG. 5 illustrates the broadened radiation pattern of the antenna shown in FIG. 3 after displacement of the main reflector and the feed horn displaced in accordance with the principle of this invention.

FIG. 5 shows the radiation contours of the exemplary system 10 when x=11.0 inches and y=23.68 inches (from Equation (1)). The 3 dB beamwidth of the beam shown in FIG. 4 is broadened to 1.45 degrees from 0.71 degrees.

Due to optical aberration, Equation (1) is an approximate expression for the displacement of the main reflector 11*a* of the variable beamwidth antenna system 10. For practical applications, a fine-tuning of the location of the main reflector 11*a* may be required.

Figure 6:
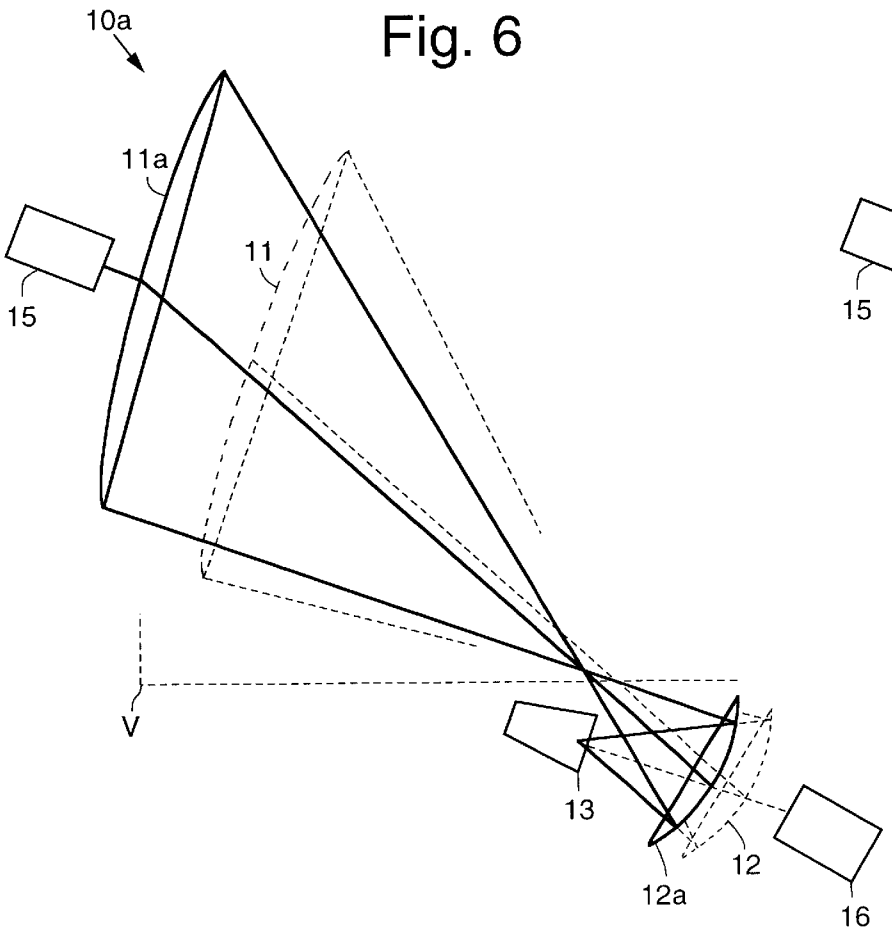
FIG. 6 illustrates a second embodiment of a variable beamwidth antenna system in accordance with the principles of the present invention.

It is also to be understood that the RF feed horn 13 can be made stationary instead of the subreflector 12 as shown in FIG. 6. More particularly, FIG. 6 illustrates a second embodiment of a variable beamwidth antenna system 10*a* in accordance with the principle of the present invention.

In the second embodiment of the variable beamwidth antenna system 10*a*, the subreflector displacement mechanism 16 displaces the subreflector 12 to a proper location and the main reflector displacement mechanism 15 displaces the main reflector 11 to a proper location while keeping the RF feed horn stationary. This system 10*a* in FIG. 6 is equivalent to the variable beamwidth antenna system 10 described above with reference to FIG. 2.

Figure 7:
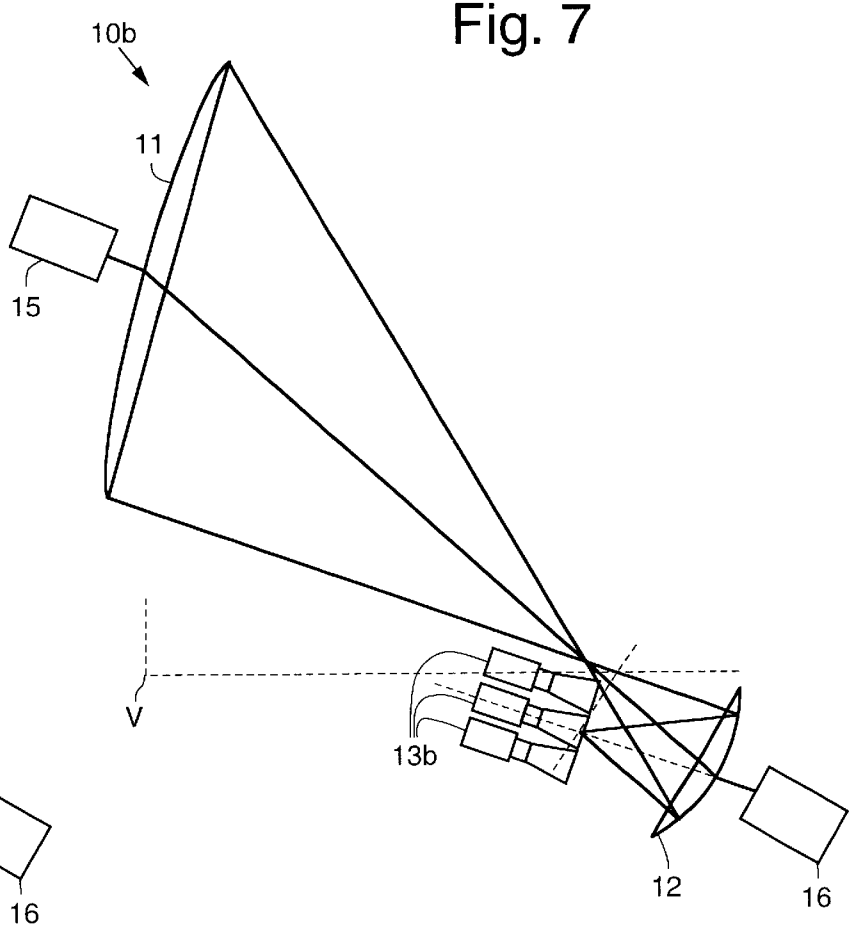
FIG. 7 illustrates a third embodiment of a variable beamwidth antenna system in accordance with the principles of the present invention.

Referring now to FIG. 7, it illustrates a third embodiment of a variable beamwidth antenna system 10*b* in accordance with the principles of the present invention. In the third embodiment of the variable beamwidth antenna system 10*b* shown in FIG. 6, there are plurality of RF feed horns 13*b* used instead of a single RF feed horn 13. As a result, there will be multiple variable beams produced by the system 10*b*.

Figure 8:
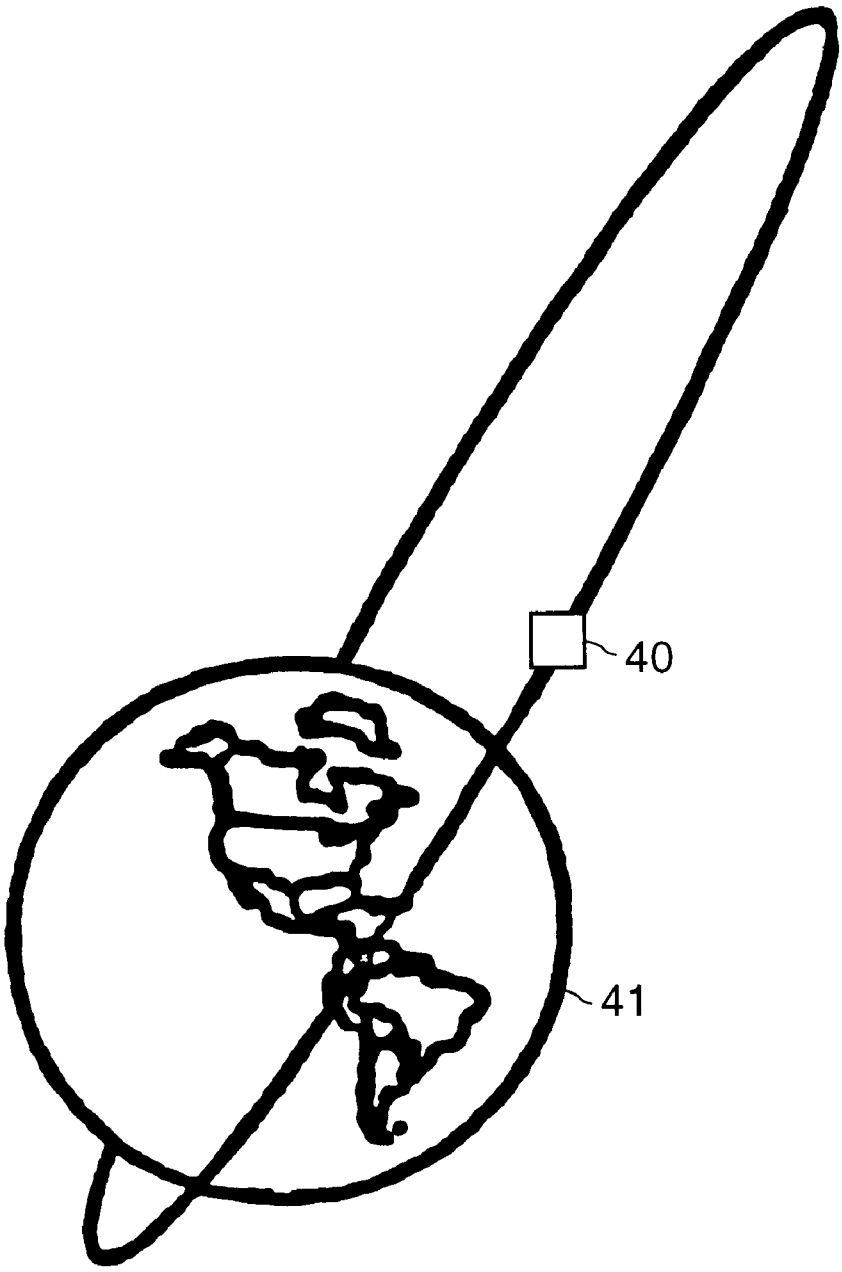
FIG. 8 illustrates a satellite in an elliptical orbit.

FIG. 8 illustrates a satellite 30 in an elliptical orbit around the Earth 31. The satellite 30 comprises a zoom contour beam antenna system 40 in accordance with the principles of the present invention.

Figure 9:
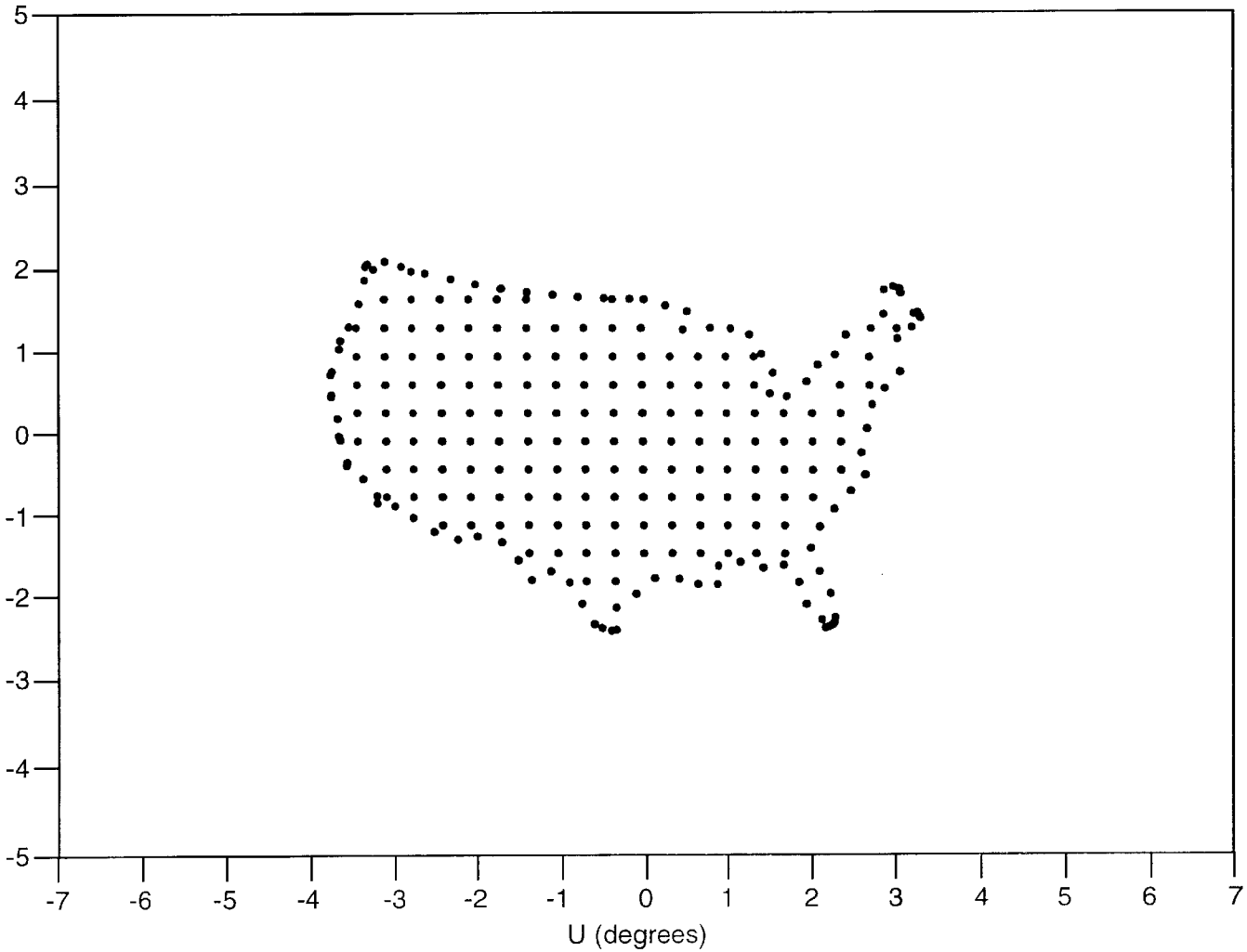
FIGS. 9, 10 and 11 show typical examples of the view of CONUS from different satellite positions in a typical elliptical orbit.
Figure 10:
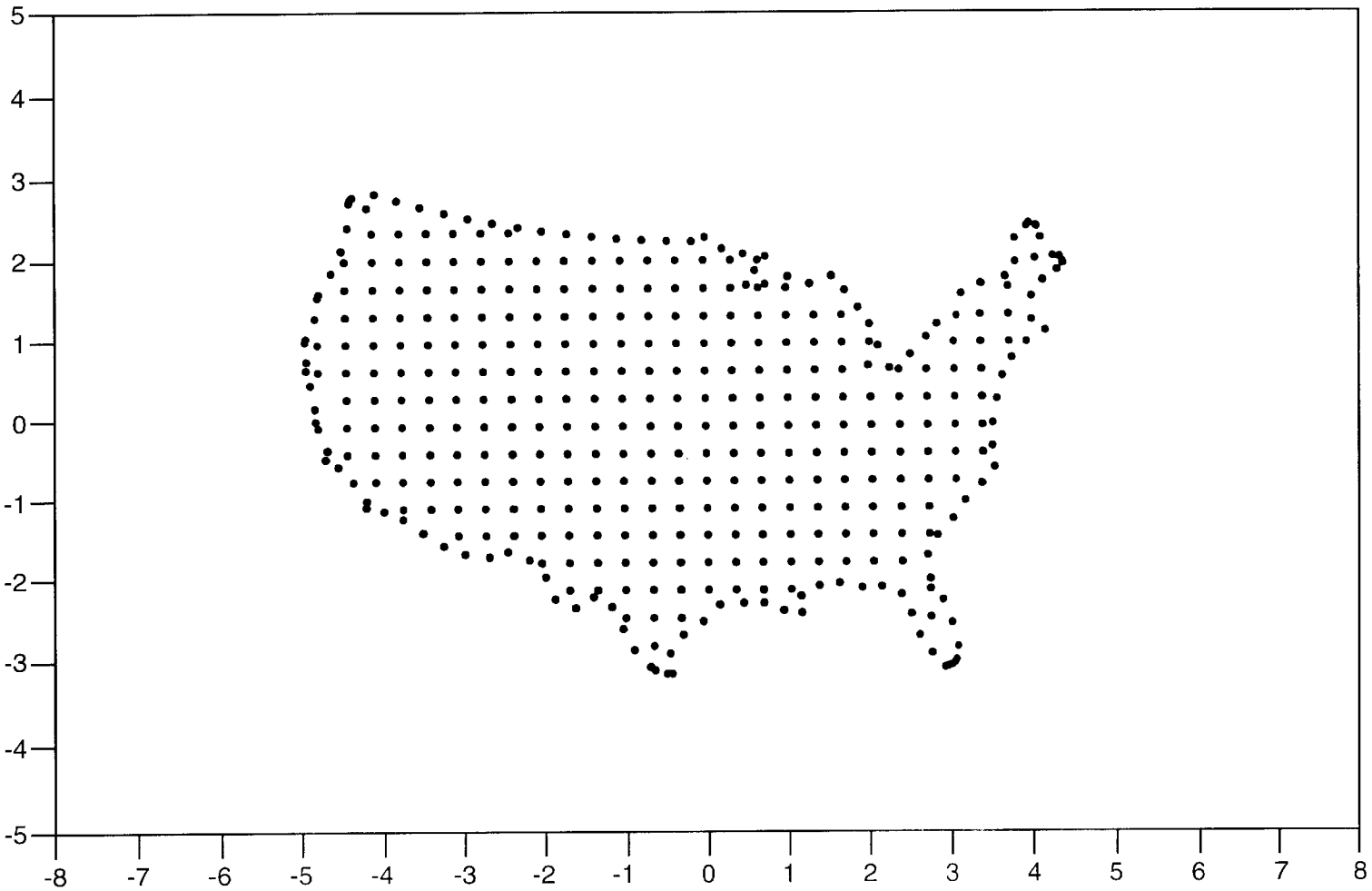
Figure 11:
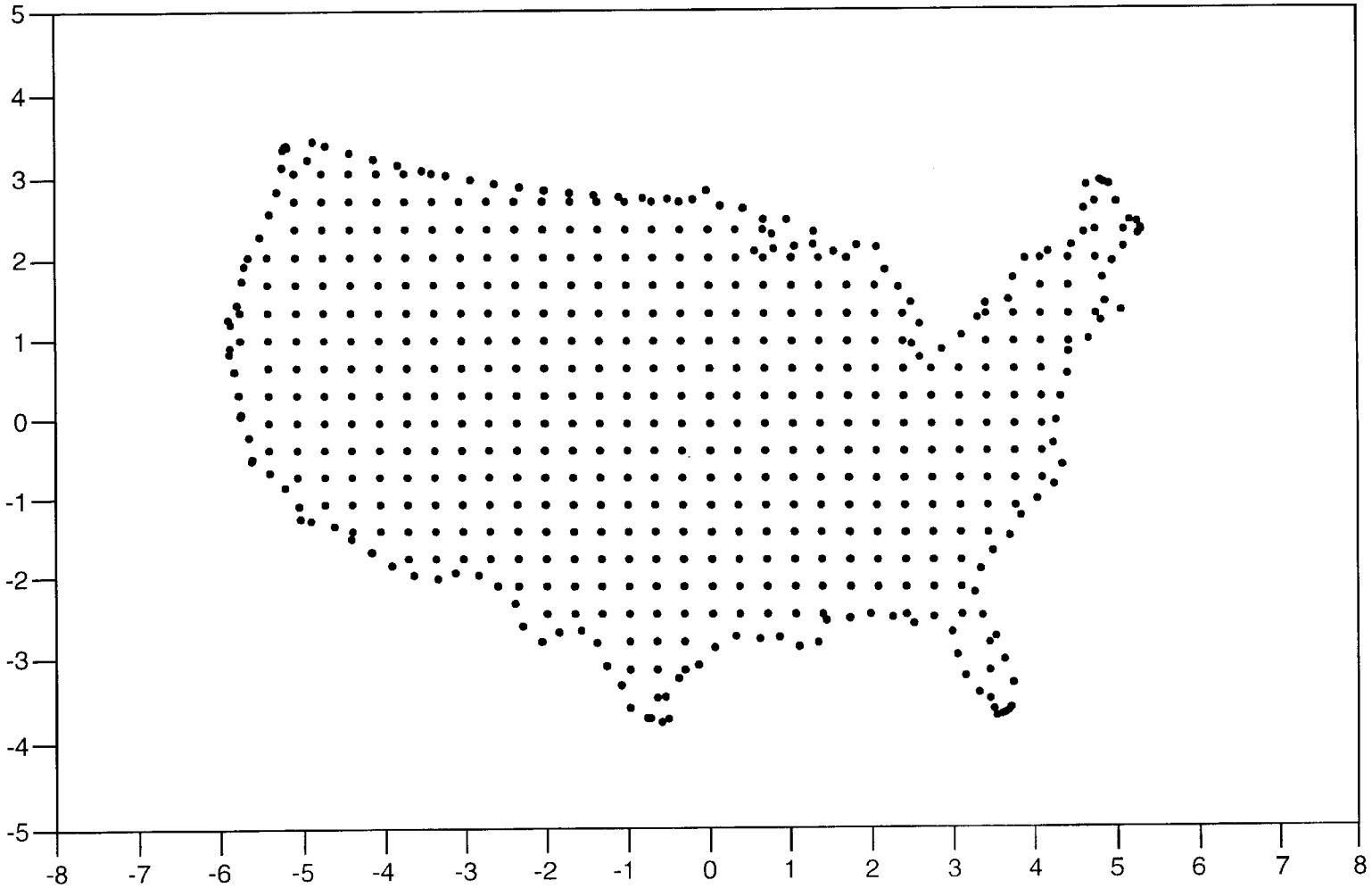

FIGS. 9, 10 and 11 show typical examples of the view of the coverage area (CONUS) from different positions of the satellite 30 in a typical elliptical orbit.

Figure 12:
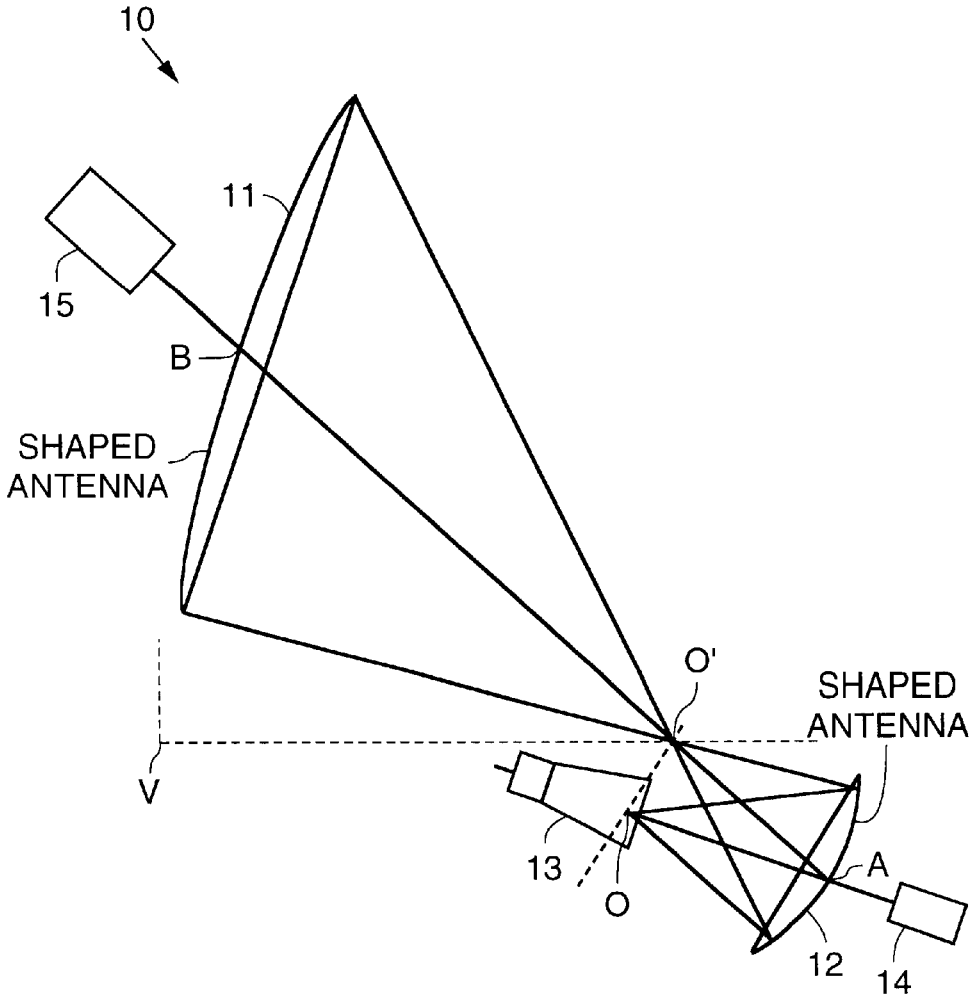
FIG. 12 illustrates a zoom contour beam antenna system in accordance with the principles of the present invention.

Referring now to FIG. 12, it illustrates an exemplary zoom contour beam antenna system 40 in accordance with the principles of the present invention. The zoom contour beam antenna system 40 comprises a shaped main reflector 11, a shaped subreflector 12, a feed horn 13, a subreflector displacement mechanism 14 and a main reflector displacement mechanism 15. The arrangement of the components of the zoom contour beam antenna system 40 are generally as was described with reference to the variable beamwidth antenna systems described previously. However, the main reflector displacement mechanism 15 is coupled to the shaped main reflector 11, and the subreflector displacement mechanism 14 is coupled to the shaped subreflector 12.

The function of the main reflector displacement mechanism 15 is to reposition the main reflector 11, and the function of the subreflector displacement mechanism 14 is to reposition the subreflector 12. Thus, the subreflector displacement mechanism 14 adjusts the position of the subreflector 12 relative to the feed horn 13, and the main reflector displacement mechanism 15 adjusts the position of the main reflector 11 relative to the subreflector 12.

Figure 13:
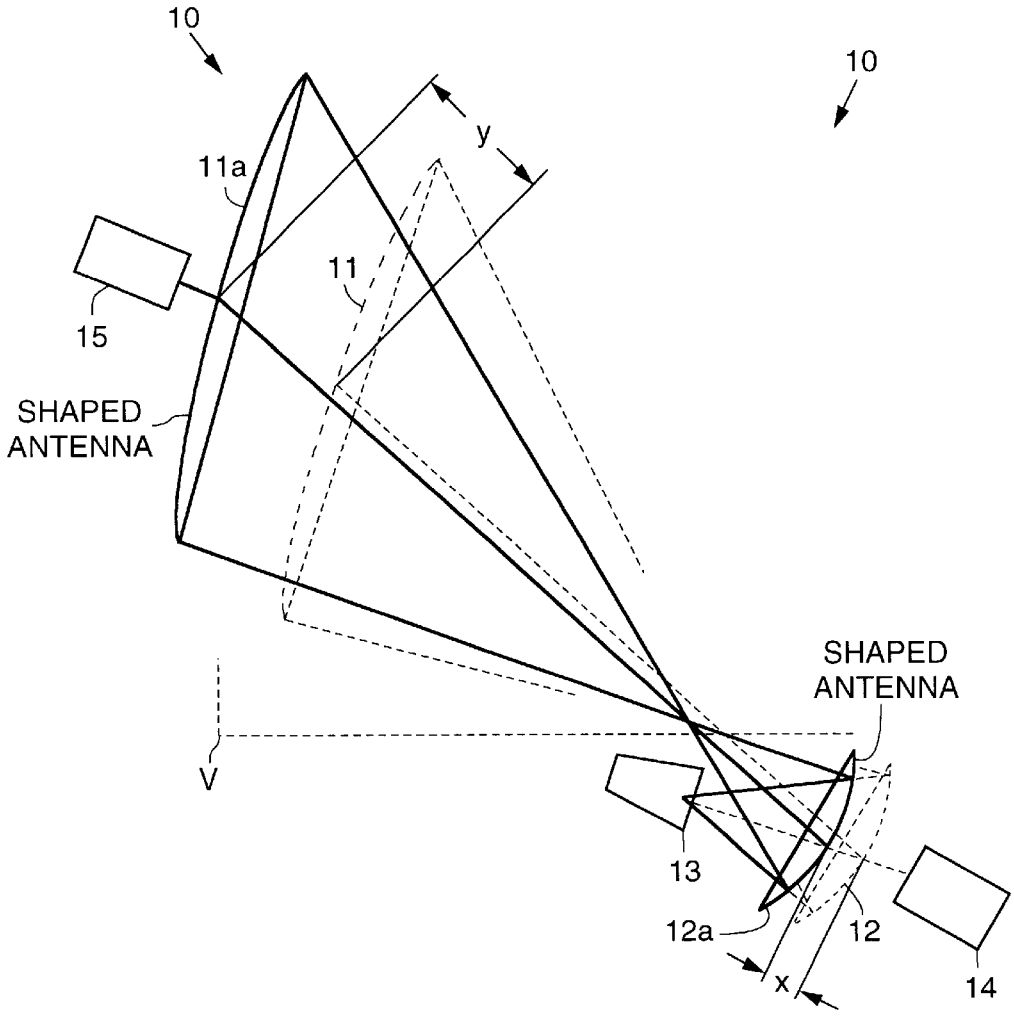
FIG. 13 illustrates movement of displacement mechanisms employed in the system shown in FIG. 12.

In order to zoom the contours, the shaped subreflector 12 must be moved (along the line AO) closer to the feed horn 13 by "x" and the shaped main reflector 11 must be pulled away (along the line AO') from the shaped subreflector 12 by "y" as shown in FIG. 13. More particularly, FIG. 13 illustrates movement of the shaped main reflector and shaped subreflector 11, 12 by the displacement mechanisms 14, 15 employed in the system 40 shown in FIG. 12. The displacements "x" and "y" are related by the displacement equation:

$$y = \frac{d^2x}{c^2 - x(c+d)},$$

where "c" is the distance AO and "d" is the distance AO' in FIG. 12.

Figure 14:
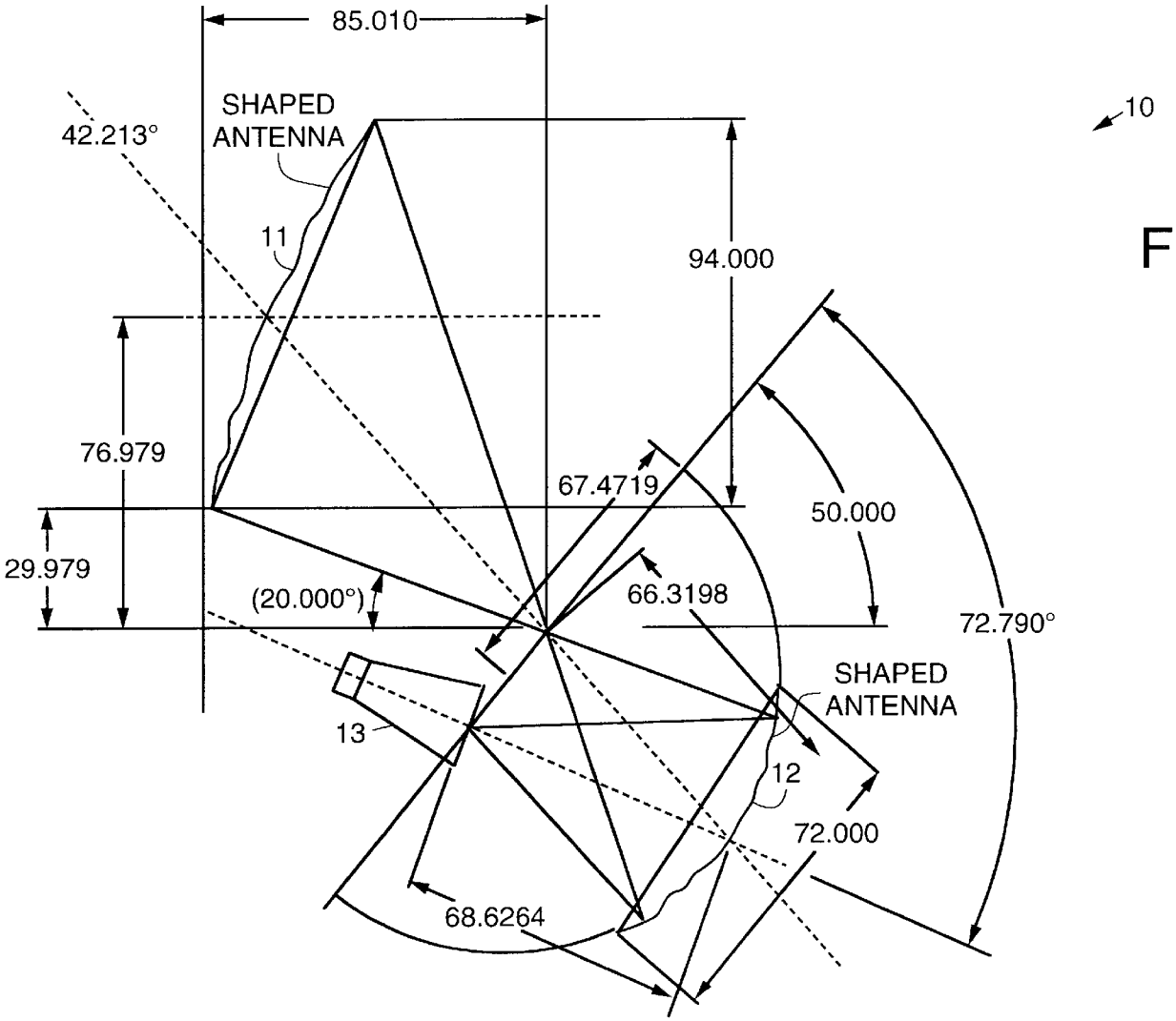
FIG. 14 illustrates an exemplary zoom contour beam antenna with exemplary design parameters.

A numerical example will now be illustrated with reference to FIG. 14. An exemplary zoom contour beam antenna system 40 having exemplary design parameters is shown in FIG. 14. The geometry of the exemplary antenna system 40 is, c=68.626 inches and d=66.319 inches. The zoom characteristics of the exemplary antenna system 40 are summarized in Table 1.

Figure 15:
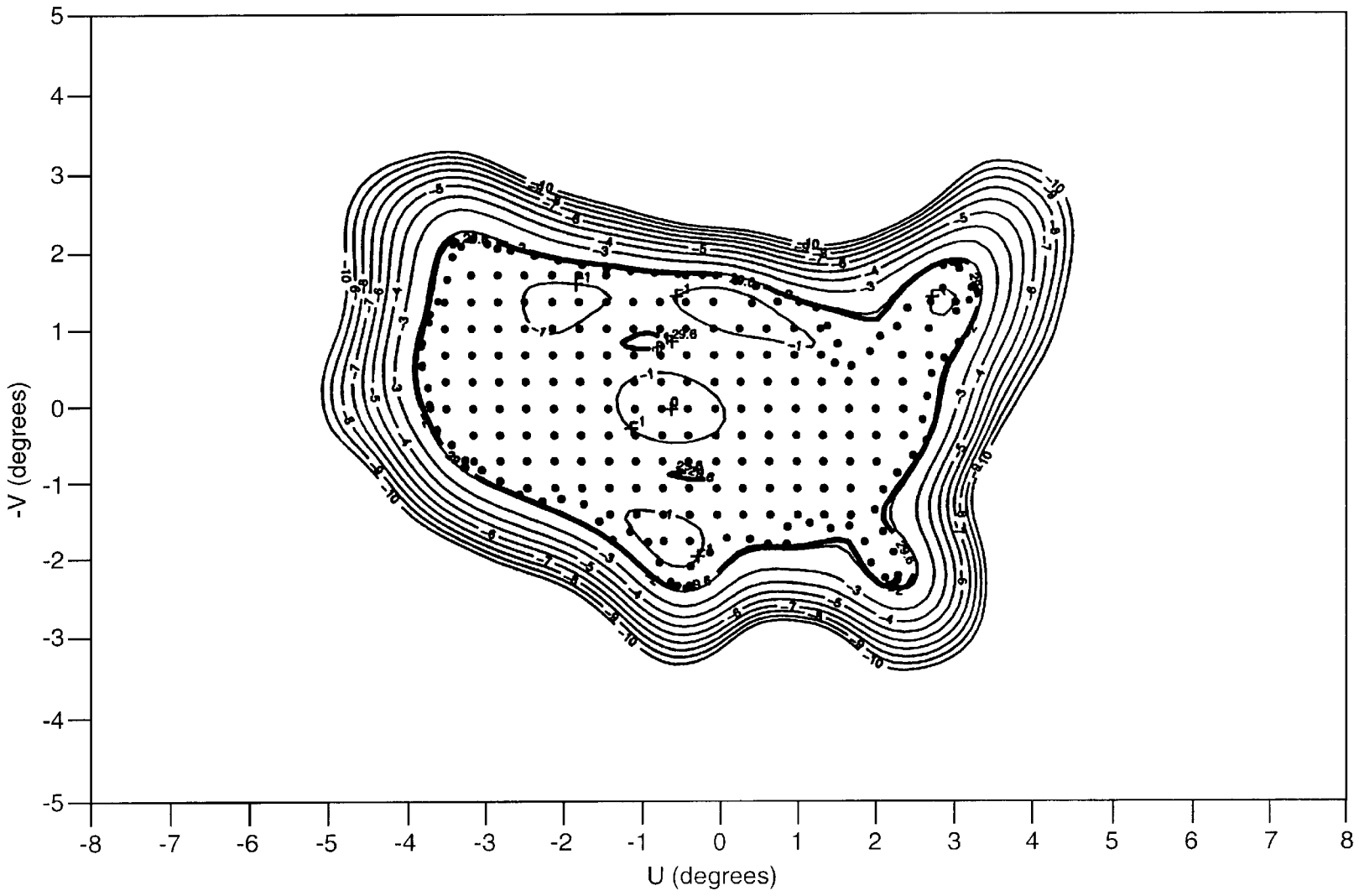
FIGS. 15, 16 and 17 show examples of radiation patterns corresponding to the examples shown in FIGS. 9, 10 and 11 showing various zoomable beams that are produced by the present invention.
Figure 16:
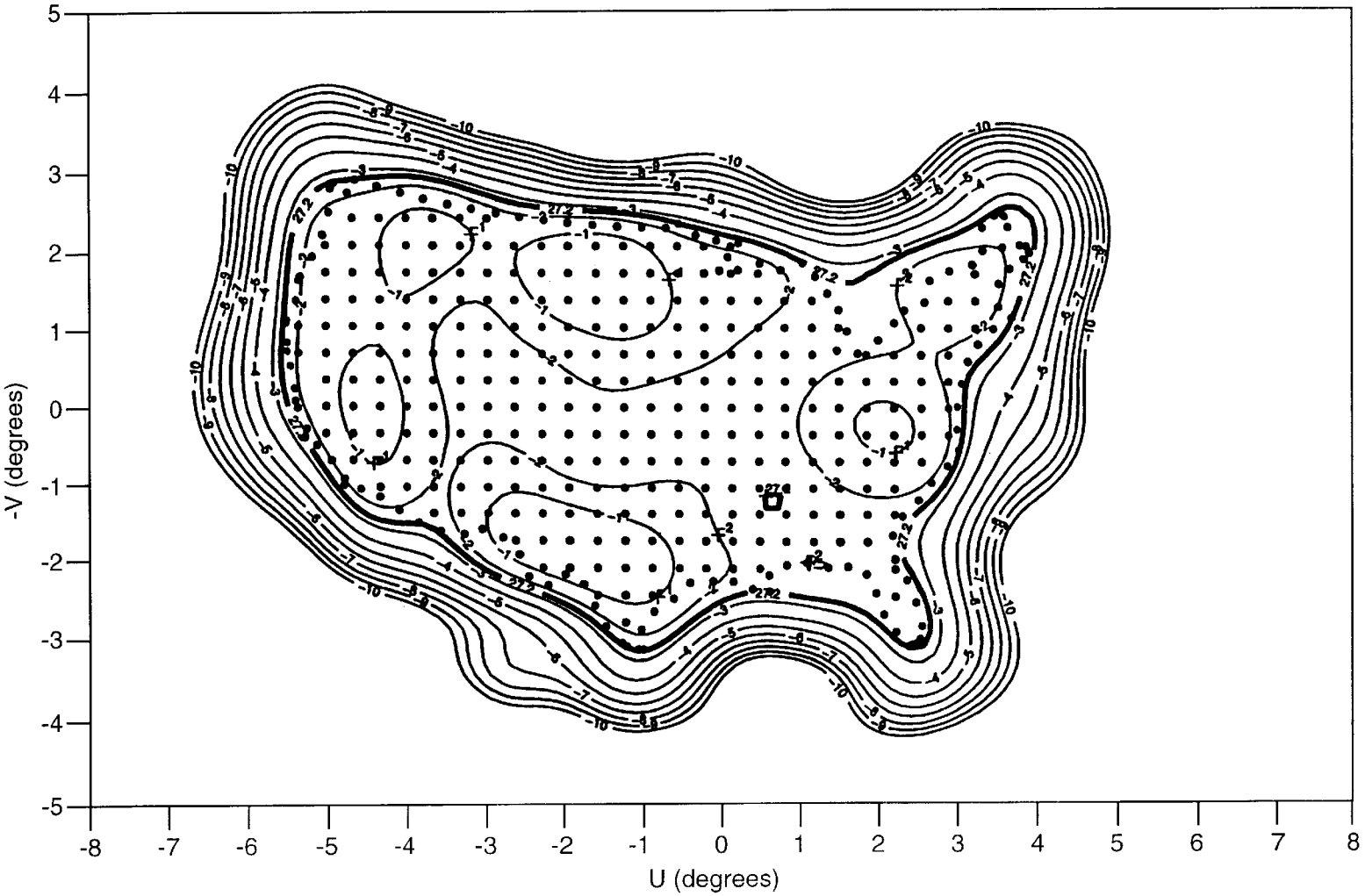
Figure 17:
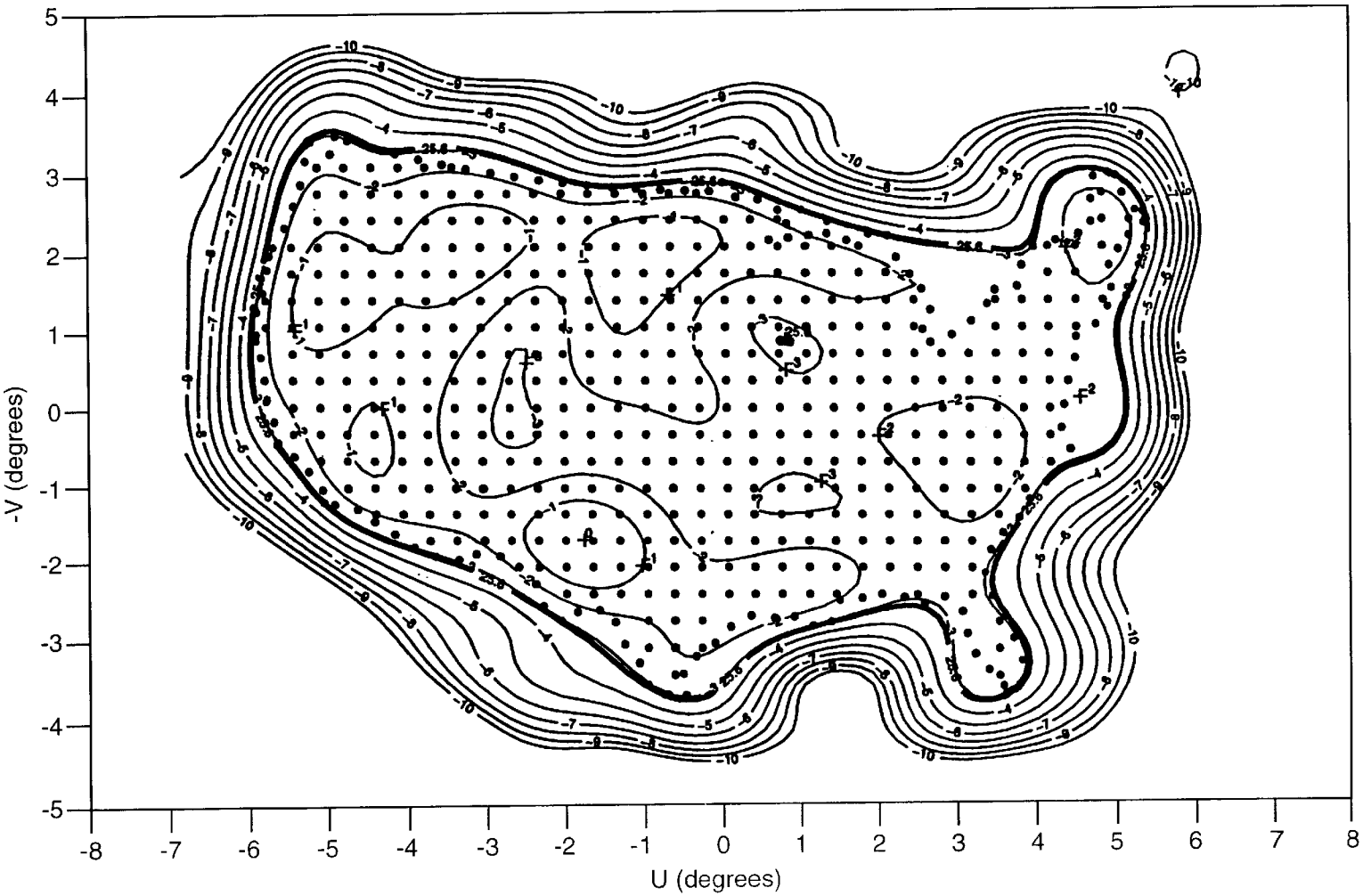

FIGS. 15, 16 and 17 show examples of radiation patterns (corresponding to the examples shown in FIGS. 9, 10 and 11) showing various zoomable beams (radiation patterns) that are produced by the present invention and which are referenced in Table 1. The term "EOC" means "edge of coverage".

TABLE 1

| Subreflector displacement x (inches) | Main reflector displacement y (inches) | Radiation pattern | EOC gain (dBi) | Zoom factor |
|---|---|---|---|---|
| 0.00 | 0.000 | FIG. 15 | 29.6 | 1.0 |
| 8.00 | 9.693 | FIG. 16 | 27.2 | 1.3 |
| 13.10 | 19.586 | FIG. 17 | 25.6 | 1.6 |

Due to optical aberration, equation (1) is an approximate expression for reflector displacements. For practical applications, a fine-tuning of the locations of the reflectors may be required.

There are three RF components in the zoom contour beam antenna system 40. These are the shaped main reflector 11, the shaped subreflector 12 and feed horn 13. It is to be understood that any one component may be chosen to be stationary.

Thus, in accordance with the principles of the present invention, a Gregorian reflector antenna system may be used when the desired antenna radiation pattern(s) is (are) required to be broadened (changed). The main reflector 11 and the subreflector 12 are attached to mechanical devices (the displacement mechanisms, 14, 15) that allow the reflectors 11, 12 to be displaced. The displacements of the two reflectors 11, 12 are related by the displacement equation.

The present invention is not limited to systems having a single pencil beam antenna, and may be used in circumstances involving multiple beam (multiple feed horn) antennas, such as is illustrated in FIG. 7. The present invention may also be employed with a contoured beam antenna. In such a contoured beam antenna application, both the main reflector 11 and subreflector 12 are shaped to obtain a desired (for example, CONUS) radiation pattern.

Thus, improved variable beamwidth antenna systems have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A zoom contour beam antenna system comprising:

a shaped subreflector;

a shaped main reflector;

a feed horn;

a main reflector displacement mechanism coupled to the shaped main reflector; and a subreflector displacement mechanism coupled to the shaped subreflector and wherein the displacement mechanisms cooperate to displace the reflectors according to a predetermined displacement relationship to cause the feed horn, the shaped subreflector, and the shaped main reflector to be separated by selected predetermined distances to zoom a beam produced by the antenna system.

2. The system recited in claim 1 wherein displacement of the shaped subreflector is controlled by the subreflector displacement mechanism which is operative to move the shaped subreflector a first predetermined distance away from the feed horn, and the main reflector is controlled by the main reflector displacement mechanism which operative to move the main reflector a second predetermined distance away from the subreflector.

3. The system recited in claim 2 wherein the first predetermined distance is "x" and the second predetermined distance is "y" and displacements "x" and "y" satisfy the equation $$y = \frac{d^2x}{c^2 - x(c+d)},$$

where "c" is the distance between the feed horn and the shaped subreflector, and "d" is the distance between the focal point of the shaped main reflector and shaped subreflector, before displacements of the shaped subreflector and the shaped main reflector are made.

4. The system recited in claim 1 wherein displacement of the shaped subreflector is controlled by the subreflector displacement mechanism which is operative to move the shaped subreflector a first predetermined distance away from the feed horn, and the main reflector is controlled by the main reflector displacement mechanism which operative to move the main reflector a second predetermined distance away from the subreflector; and wherein the first predetermined distance is "x" and the second predetermined distance is "y" and displacements "x" and "y" satisfy the equation $$y = \frac{d^2x}{c^2 - x(c+d)},$$

where "c" is the distance between the feed horn and the shaped subreflector, and "d" is the distance between the focal point of the shaped main reflector and shaped subreflector, before displacements of the shaped subreflector and the shaped main reflector are made.

5. The system recited in claim 1 wherein point A is the intersection point of a line through the axis of the feed horn and the surface of the shaped subreflector, and point B is the intersection point of a line through point A and O' and the surface of the shaped main reflector;

wherein the shaped main reflector is moved away from the shaped subreflector along a line through points A, O' and B and is located at a distance from point O' equal to the distance between points O' and B plus "y", where the distance "y" is determined by the equation $$y = \frac{d^2x}{c^2 - x(c+d)},$$

where "c" is the distance between O and A, "d" is the distance between O and A, and the feed horn and the subreflector are separated along a line through points A and O by a distance equal to the distance between points A and O minus "x".

6. The system recited in claim 1 comprising a plurality of additional feed horns.

7. A zoom contour beam antenna system comprising:

a shaped subreflector;

a shaped main reflector;

a feed horn;

a main reflector displacement mechanism coupled to the shaped main reflector; and a subreflector displacement mechanism coupled to the shaped subreflector;

wherein displacement of the shaped subreflector is controlled by the subreflector displacement mechanism which is operative to move the shaped subreflector a first predetermined distance away from the feed horn, and the main reflector is controlled by the main reflector displacement mechanism which operative to move the main reflector a second predetermined distance away from the subreflector.

8. The system recited in claim 7 wherein the first predetermined distance is "x" and the second predetermined distance is "y" and displacements "x" and "y" satisfy the equation $$y = \frac{d^2x}{c^2 - x(c+d)},$$

where "c" is the distance between the feed horn and the shaped subreflector, and "d" is the distance between the focal point of the shaped main reflector and shaped subreflector, before displacements of the shaped subreflector and the shaped main reflector are made.

9. The system recited in claim 7 wherein point A is the intersection point of a line through the axis of the feed horn and the surface of the shaped subreflector, and point B is the intersection point of a line through point A and O' and the surface of the shaped main reflector;

wherein the shaped main reflector is moved away from the shaped subreflector along a line through points A, O' and B and is located at a distance from point O' equal to the distance between points O' and B plus "y", where the distance "y" is determined by the equation $$y = \frac{d^2x}{c^2 - x(c+d)},$$

where "c" is the distance between O and A, "d" is the distance between O' and A, and the feed horn and the subreflector are separated along a line through points A and O by a distance equal to the distance between points A and O minus "x".

10. The system recited in claim 7 comprising a plurality of additional feed horns.

11. A zoom contour beam antenna system comprising:

a shaped subreflector;

a shaped main reflector;

a feed horn;

a main reflector displacement mechanism coupled to the shaped main reflector; and a subreflector displacement mechanism coupled to the shaped subreflector;

wherein displacement of the shaped subreflector is controlled by the subreflector displacement mechanism which is operative to move the shaped subreflector a first predetermined distance away from the feed horn, and the main reflector is controlled by the main reflector displacement mechanism which operative to move the main reflector a second predetermined distance away from the subreflector; and wherein the first predetermined distance is "x" and the second predetermined distance is "y" and displacements "x" and "y" satisfy the equation $$y = \frac{d^2x}{c^2 - x(c+d)},$$

where "c" is the distance between the feed horn and the shaped subreflector, and "d" is the distance between the focal point of the shaped main reflector and shaped subreflector, before displacements of the shaped subreflector and the shaped main reflector are made.

12. The system recited in claim 11 wherein point A is the intersection point of a line through the axis of the feed horn and the surface of the shaped subreflector, and point B is the intersection point of a line through point A and O' and the surface of the shaped main reflector;

wherein the shaped main reflector is moved away from the shaped subreflector along a line through points A, O' and B and is located at a distance from point O' equal to the distance between points O' and B plus "y", where the distance "y" is determined by the equation $$y = \frac{d^2x}{c^2 - x(c+d)},$$

where "c" is the distance between O and A, "d" is the distance between O' and A, and the feed horn and the subreflector are separated along a line through points A and O by a distance equal to the distance between points A and O minus "x".

13. The system recited in claim 12 comprising a plurality of additional feed horns.

* * * * *